US010683660B2

(12) United States Patent
Preston

(10) Patent No.: US 10,683,660 B2
(45) Date of Patent: Jun. 16, 2020

(54) EXTERIOR WALL SYSTEM

(71) Applicant: INNOVATIONS & IDEAS, LLC, Tampa, FL (US)

(72) Inventor: Steven Preston, Tampa, FL (US)

(73) Assignee: INNOVATIONS & IDEAS, LLC, Tampa, FL (US)

( * ) Notice: Subject to any disclaimer, the term of this patent is extended or adjusted under 35 U.S.C. 154(b) by 0 days.

(21) Appl. No.: 16/426,053

(22) Filed: May 30, 2019

(65) Prior Publication Data

US 2019/0277024 A1 Sep. 12, 2019

Related U.S. Application Data

(63) Continuation of application No. 15/982,809, filed on May 17, 2018, now Pat. No. 10,352,040, which is a continuation of application No. 15/228,411, filed on Aug. 4, 2016, now Pat. No. 10,017,936, which is a continuation of application No. 14/276,525, filed on May 13, 2014, now Pat. No. 9,435,114, which is a continuation of application No. 13/301,155, filed on Nov. 21, 2011, now abandoned.

(60) Provisional application No. 61/416,919, filed on Nov. 24, 2010.

(51) Int. Cl.
*E04B 1/68* (2006.01)
*E04F 13/06* (2006.01)

(52) U.S. Cl.
CPC ..... *E04B 1/6807* (2013.01); *E04B 1/6801* (2013.01); *E04B 1/6803* (2013.01); *E04B 1/6812* (2013.01); *E04F 13/06* (2013.01); *E04F 2013/066* (2013.01)

(58) Field of Classification Search
CPC .... E04B 1/6807; E04B 1/6812; E04B 1/6801; E04B 1/6803; E04F 13/06; E04F 2013/066
USPC ..... 52/396.05, 396.04; 404/47, 48, 49, 50, 404/51, 52, 53, 54, 55, 56, 57, 58, 59, 60, 404/61, 62, 63, 64, 65, 66, 67, 68, 69, 70
See application file for complete search history.

(56) References Cited

U.S. PATENT DOCUMENTS 629,337 A * 7/1899 Cartwright ..... E04F 19/064 52/254
2,040,367 A * 5/1936 Eichelman ..... E01C 11/14 404/60
2,046,182 A * 6/1936 Robertson ..... E01C 11/14 404/55

(Continued)

FOREIGN PATENT DOCUMENTS

DE 19537444 A1 * 4/1997 ..... E01C 11/08
DE 20005325 U1 * 5/2000 ..... E04B 1/681

(Continued)

*Primary Examiner* — Joshua J. Michener
*Assistant Examiner* — Joseph J. Sadlon
(74) *Attorney, Agent, or Firm* — Christopher Paradies; Paradies Law P.A.

(57) ABSTRACT

A vertical exterior wall system has an exterior substrate and a control joint disposed on the substrate. A building material such as stucco covers a base plate of the control joint. An A-shaped ridge extends from the based plate of the control joint and is disposed between a first area of the building material and a second area of the building material, defining a gap. A sealant may be disposed in the gap and may cover the A-shaped ridge, adhering to building materials of the first area and the second area.

11 Claims, 14 Drawing Sheets

(56) References Cited

U.S. PATENT DOCUMENTS

RE20,378 E * 5/1937 Hall et al. ..... E01C 11/123 404/69
2,198,084 A * 4/1940 Jacobson ..... E01C 11/12 404/69
2,298,251 A * 10/1942 Burson ..... E04F 13/045 52/238.1
2,315,588 A * 4/1943 Brickman ..... E01C 11/126 277/645
2,405,844 A * 8/1946 Mortenson ..... E01C 11/08 404/69
3,124,047 A * 3/1964 Graham ..... E01C 11/10 404/47
3,292,330 A * 12/1966 Tennison ..... E04B 1/6803 49/495.1
3,589,664 A * 6/1971 Middlestadt ..... E01C 23/021 249/150
3,694,976 A * 10/1972 Warshaw ..... E04B 1/6815 52/396.04
3,750,359 A * 8/1973 Balzer ..... D06B 5/16 404/57
4,067,155 A * 1/1978 Ruff ..... E04B 1/6803 4/498
4,346,542 A * 8/1982 Tateno ..... E01C 11/10 404/48
4,454,696 A * 6/1984 Tuttle ..... E04B 1/681 428/122
4,597,235 A * 7/1986 Olsen ..... E04F 13/12 52/235
4,736,563 A * 4/1988 Bilhorn ..... A01G 9/14 52/460
4,829,740 A * 5/1989 Hutchison ..... E04B 2/90 52/475.1
4,912,898 A * 4/1990 Holmes ..... E04C 2/54 52/204.593
5,006,011 A * 4/1991 Hiyashi ..... E01O 5/001 404/37
5,339,588 A * 8/1994 Ballstadt ..... E04C 1/42 52/308
6,035,598 A * 3/2000 Sukolics ..... E04F 13/081 52/235
6,418,688 B1 * 7/2002 Jones, Jr. ..... E01C 11/10 404/64
6,591,559 B2 * 7/2003 Contreras ..... E04B 1/762 43/1
6,598,364 B1 * 7/2003 Pelles ..... E01C 11/126 404/47
6,984,670 B2 * 1/2006 Meyers, III ..... B29B 17/0042 521/40
7,021,858 B2 * 4/2006 Beloreshka ..... E01C 9/002 404/47
7,284,357 B2 * 10/2007 McInerney ..... E04B 5/00 52/396.03
7,757,450 B2 * 7/2010 Reyes ..... E04F 13/06 14/73.5
2006/0150553 A1 * 7/2006 Reyes ..... E04F 13/06 52/393
2008/0197576 A1 * 8/2008 Trout ..... E04B 1/6813 277/312
2012/0011794 A1 * 1/2012 McCorkle ..... E04B 1/483 52/396.02

FOREIGN PATENT DOCUMENTS

DE 10220748 A1 * 11/2003 ..... E04F 15/14
FR 2350522 A2 * 12/1977 ..... B65D 90/08

* cited by examiner

Figure 3 (a) (Prior Art)
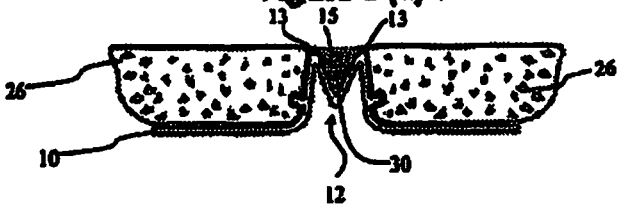
Figure 3 (b)
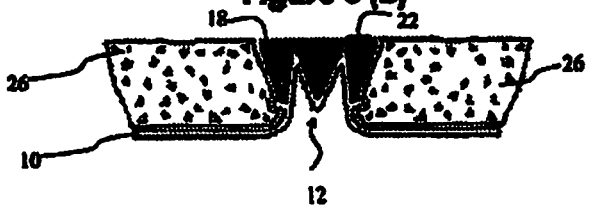
Figure 3 (c)
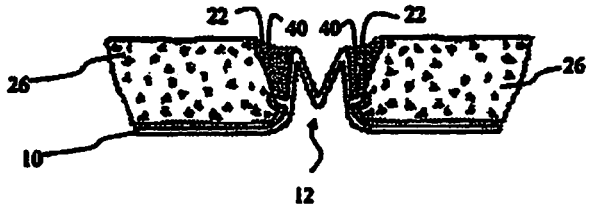

FIG. 8(a) (Prior Art)
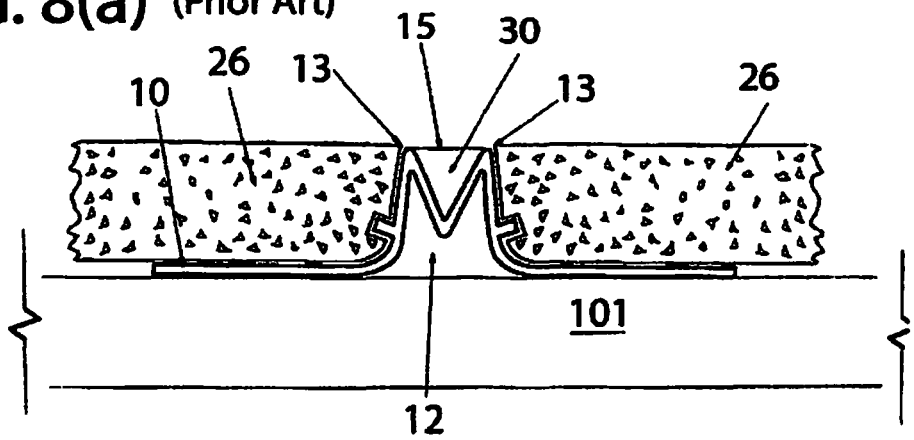
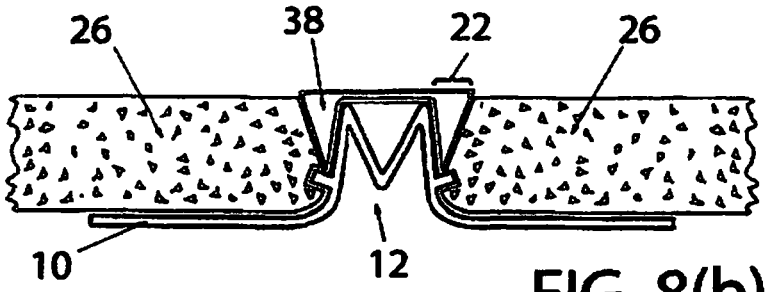
FIG. 8(b)
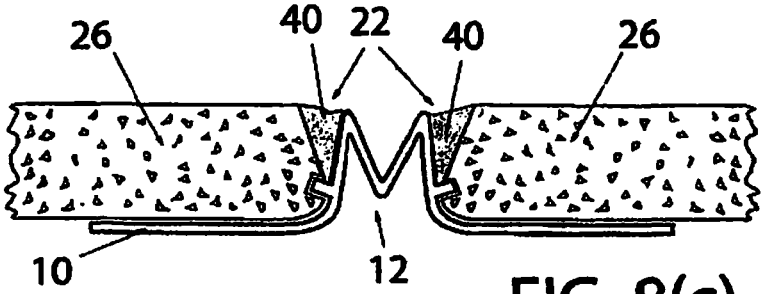
FIG. 8(c)

EXTERIOR WALL SYSTEM

CROSS RELATED APPLICATIONS

This application is a continuation of application Ser. No. 15/982,809 filed on May 17, 2018, which is a continuation of application Ser. No. 15/228,411 filed Aug. 4, 2016 now U.S. Pat. No. 10,017,936, which is a continuation of application Ser. No. 14/276,525 filed May 13, 2014, which is a continuation of application Ser. No. 13/301,155, which was filed Nov. 21, 2011, entitled EXPANSION OR CONTROL JOINT AND GASKET SYSTEM, which claimed the benefit of U.S. Provisional Appl. No. 61/416,919, filed Nov. 24, 2010, the contents of which are hereby incorporated by reference into this disclosure.

FIELD OF THE INVENTION

The field of the invention relates to building materials, specifically to expansion and control joints used in exterior building surfaces.

BACKGROUND

Expansion or control joints are known in the art. While conventional expansion or control joints fulfill their respective, particular objectives and requirements to an extent, they do not disclose expansion or control joints with a structure such that sealant can be placed within opening(s) between the expansion or control joint and the building material, such as stucco. Therefore, the sealant does not sufficiently bond to the expansion and control joint and to the building material, and the sealant cannot prevent water penetration at the interface between the expansion or control joint and the building material. For example, in a conventional M type expansion or control joint, the top center of the M may include a removable tape. The tape creates a V shaped cavity that prevents the building material (e.g., stucco, synthetic, cement, or other suitable material) from spreading into the V shaped cavity during installation. The building material is troweled on using the expansion or control joint as a gauge to trowel the building material to its top edge. After the building material has cured, though, there is no significant bond between the building material and the expansion or control joint, thus allowing water penetration at an interface between the expansion or control joint and the building material. Substantial damage may be caused, over time, as the water penetrates the interface and finds its way under the building material between the building material and a substrate on which the building material is applied.

Water penetrating into the expansion or control joint and under the building material compromises the structural integrity of the joint and building material. Water may also remain stagnant and promote fungal and mold growth, which can not only further compromise the structural integrity of the building material but also cause health problems for individuals in proximity. Water penetration can also damage the aesthetic of the wall from which the building material is made.

Typically, a sealant can be used to prevent water penetration. However, conventional expansion or control joints do not have enough space at the interface between the building material and the expansion or control joint to insert a sufficient amount of sealant to create a bond to both the expansion or control joint and the building material, in order to prevent water penetration.

It was not contemplated how this space could be created without compromising functionality, cost of manufacture, and/or ease of installation of the expansion or control joint, while still conforming to industry standards such as the Whole Building Design Guide, ASTM International, American Institute of Architects, MasterSpec, Department of Defense and/or Department of Veterans Affairs with regards to how wide the space can be, width-to-depth ratios, application of joint sealants and other specifications.

Accordingly, what is needed is a system that enables secure bonding between an expansion or control joint and a building material while preventing water penetration between the building material and the expansion or control joint. However, in view of the art considered as a whole at the time the present invention was made, it was not obvious to those of ordinary skill how the art could be advanced.

While certain aspects of conventional technologies have been discussed to facilitate disclosure of the invention, Applicants in no way disclaim these technical aspects, and it is contemplated that the claimed invention may encompass one or more of the conventional technical aspects discussed herein.

The present invention may address one or more of the problems and deficiencies of the prior art discussed above. However, it is contemplated that the invention may prove useful in addressing other problems and deficiencies in a number of technical areas. Therefore, the claimed invention should not necessarily be construed as limited to addressing any of the particular problems or deficiencies discussed herein.

In this specification, where a document, act or item of knowledge is referred to or discussed, this reference or discussion is not an admission that the document, act or item of knowledge or any combination thereof was at the priority date, publicly available, known to the public, part of common general knowledge, or otherwise constitutes prior art under the applicable statutory provisions; or is known to be relevant to an attempt to solve any problem with which this specification is concerned.

SUMMARY

In one example, an expansion or control joint system comprises an expansion or control joint that has an expansion region connecting two planar lath panels, made of a building material, and a gasket having a void disposed in overlying relation to the expansion region, the void sufficiently matching the shape of the expansion region, such that when the gasket is removed, an opening is formed for a sealant, which may be placed within the opening. The exterior surface of a building then comprises a substrate, an expansion or control joint fixed to the substrate, a building material applied on the substrate and overlapping onto a portion of the expansion or control joint, and a sealant disposed in an opening, sufficiently bonding to the expansion or control joint and to the building material, such that the gap between the expansion and control joint and the building material is sealed by the sealant disposed within the opening.

In another example, an expansion region is M-shaped, and a void of the gasket is M-shaped. Alternatively, a void of the gasket is V shaped. Yet another alternative has a cap-shaped gasket. A sealant may include not only fluid materials but also more rigid materials, such as backer rods.

In one example, one or more flanges protrude from the base of the expansion region. When these flanges are present, the gasket can remain disposed in overlying relation to the expansion region permanently, for example.

In another example, a gasket may extend beyond the apex of the expansion region, allowing the gasket to be used as a gauge while the building material is being troweled onto an exterior of a building, for example.

In one example, an expansion region is A-shaped, and a void of the gasket may be A-shaped, for example.

In each example, an opening is formed that permits a sealant to be disposed as a bead, sealing an interface between the expansion or control joint and the building material, whereby water is prevented from entering the interface between the expansion or control joint and the building material.

BRIEF DESCRIPTION OF THE DRAWINGS

The following drawings are illustrative examples and do not further limit any claims that may eventually issue.

FIG. 3(*a*) depicts a bottom view of an M shaped expansion or control joint having a building material applied to it as in the prior art.

FIG. 3(*b*) depicts a bottom view of an M shaped expansion or control joint having a gasket that extends beyond the top edge of the expansion or control joint.

FIG. 3(*c*) depicts a bottom view of an M shaped expansion or control joint having a sufficient opening for the placement of a sealant to sufficiently bond the expansion or control joint and a building material together, sealing the gap between them, after the gasket has been removed.

FIG. 5(*b*) depicts a bottom view of an M shaped expansion or control joint having a gasket that extends beyond the top edge of the expansion or control joint.

FIG. 5(*c*) depicts a bottom view of an M shaped expansion or control joint having a sufficient opening for the placement of a sealant to sufficiently bond the expansion or control joint and a building material together, sealing the gap between them, after the gasket has been removed.

FIG. 7(*b*) depicts a bottom view of an M shaped expansion or control joint after a gasket has been removed and a sealant inserted.

FIG. 8(*a*) depicts a bottom view of an M shaped expansion or control joint having a building material applied to it as in the prior art.

FIG. 8(*b*) depicts a bottom view of an M shaped expansion or control joint having a more rigid reusable gasket that extends beyond the top edge of the expansion or control joint.

FIG. 8(*c*) depicts a bottom view of an M shaped expansion or control joint having a sufficient opening for the placement of a sealant to sufficiently bond the expansion or control joint and a building material together, sealing the gap between them, after the gasket has been removed.

FIG. 11(*b*) depicts a bottom view of an M shaped expansion or control joint having a sufficient opening for the placement of a backer rod and sealant to sufficiently bond the expansion or control joint and a building material together after the gasket has been removed.

FIG. 12(*b*) depicts a bottom view of an A shaped expansion or control joint having a sufficient opening for the placement of a sealant to sufficiently bond the expansion or control joint and a building material together after the gasket has been removed.

FIG. 15(*b*) depicts a bottom view of the expansion or control joint of FIG. 14 with termination channel and removable gasket strip without a pre-installed gasket or backer rod.

When the same reference characters are used, these labels refer to similar parts in the examples illustrated in the drawings.

DETAILED DESCRIPTION

The detailed description provides examples of a building material including an expansion or control joint. Reference may be made to the front, back, top, and bottom of an expansion or control joint for orientation of the drawings. For example, orientation may be in reference to the expansion or control joint positioned longitudinally along a wall, substantially horizontal to a ground plane reference. Expansion or control joints may come in several configurations and may be used for different purposes during preparation of an exterior surface of a building. Examples of expansion and control joints include M-type and A-type expansion or control joints for use in the installation of stucco; however, other building materials and other types of expansion or control joints are included within the scope of this application.

For example, an expansion or control joint is comprised of any suitable material, such as concrete, plastic, cork, foam, fiberglass, wood and suitable metals or alloys, rubber, and their derivatives thereof, alone or in combination.

In one example, a gasket is comprised of any suitable material, such as concrete, plastic, cork, foam, fiberglass, wood and suitable metals or alloys, rubber, and derivatives thereof, alone or in combination.

In one example, a sealant is comprised of any suitable material capable of preventing or reducing water penetration into the expansion or control joint and/or under the building material. Examples include, but are not limited to, latex, polysulfide, silicone, polyurethane, acrylic, urethane, butyl, flexible foam, epoxy and other polymeric types, and derivatives thereof, along with more rigid materials, such as a backer rod. It is contemplated that these materials can be used alone or in combination.

Figure 1:
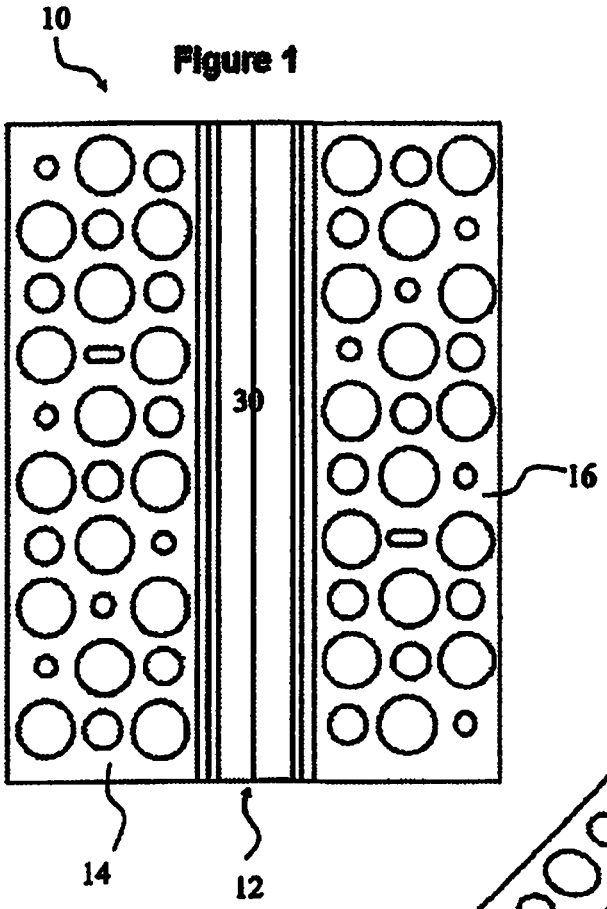
FIG. 1 depicts a front view of an M shaped expansion or control joint.
Figure 2:
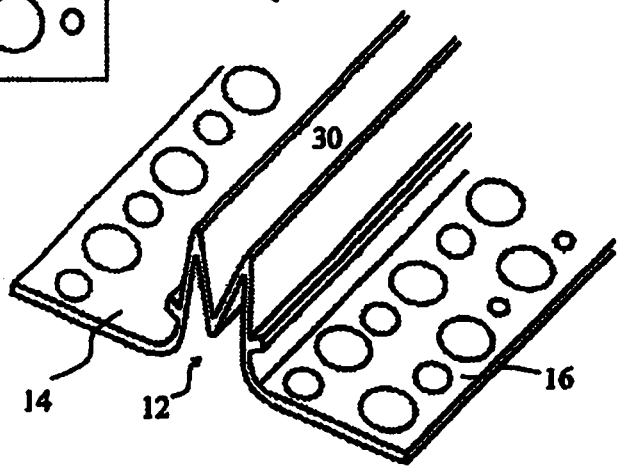
FIG. 2 depicts a upper perspective view of the M shaped expansion or control joint of FIG. 1.

As depicted in FIGS. 1 and 2, an example of an expansion or control joint, generally denoted by numeral 10, comprises a generally M shaped expansion region 12 disposed longitudinally along expansion or control joint 10. The generally M-shaped expansion region 12 connects a first building material 14, such as a planar lath panel, and a second building material 16, such as a second planar lath panel. An M-shaped expansion region 12 may include a V-shaped center portion 30.

As depicted in FIG. 3(*a*), in the prior art, a building material 26 is applied to a substrate and overlapping a portion of an expansion or control joint 10 up to the top edge 13 of expansion region 12. Tape 15 is placed over V-shaped center portion 30 of expansion region 12 to prevent building material 26 from entering V shaped center portion 30 during installation. After the building material 26 has cured, there is no significant bond between the building material 26 and the expansion or control joint 10. Because there is no significant bond, water easily penetrates into an interface between the expansion or control joint 10 and the building material 26, and finds its way under the building material 26, and/or at the top edge 13. A sealant may be applied at the interface to prevent water penetration. However, as discussed, the prior art has failed to create an expansion or control joint with enough space between building material 26 and expansion or control joint 10 to insert a sufficient amount of sealant to seal the interface between the expansion or control joint 10 and the building material 26.

For example, as depicted in FIGS. 3(*b*)-4, a removable gasket 18 includes an M-shaped surface that is adapted to fit in overlying relation to voids of the M-shaped expansion region 12. Removable gasket 18 extends laterally beyond the boundary of M shaped expansion region 12 such that an opening 22 is created, when the removable gasket 18 is removed from the M-shaped expansion region 12. As depicted in FIG. 3(*c*), for example, a sealant 40 is disposed within the opening 22 of the gap between expansion or control joint an the building material. The sealant 40 fills the opening and sufficiently bonds to the expansion or control joint 10 to the building material 26 sealing the gap between the expansion or control joint and the building material 26, after the gasket has been removed and the sealant disposed in the opening 22 sets or cures.

Figure 4:
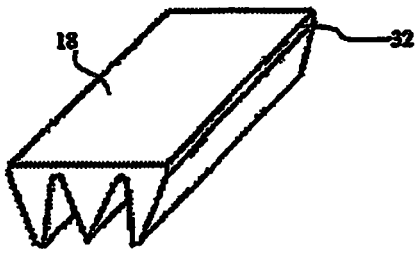
FIG. 4 depicts an upper perspective view of the M shaped expansion or control joint gasket used in FIG. 3(*b*).

For example, as depicted in FIG. 4, a removable gasket 18 includes upper extension 32 that extends beyond the top edge 13 of the M shaped expansion region 12 of FIG. 3(*b*). The upper extension 32 may be used as a gauge for the thickness of building material 26 as it is troweled on. The upper extension 32 allows for a thicker application of building material 26 (or a lower profile expansion joint), creating additional surface area on building material 26 to which the sealant 40 may be bonded, as depicted in FIG. 3(*c*). In this way, the sealant bonds to both the expansion or control joint 10 and the building material 26, sealing the interface between the expansion or control joint 10 and the building material 26 disposed on each side of the expansion or control joint 10, with a single bead of sealant 40.

Figure 5:
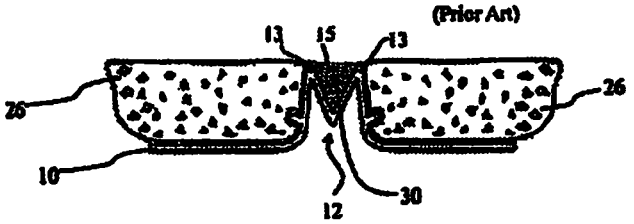
Figure 5 (a) (Prior Art)
FIG. 5(*a*) depicts a bottom view of an M shaped expansion or control joint having a building material applied to it as in the prior art.
Figure 5:
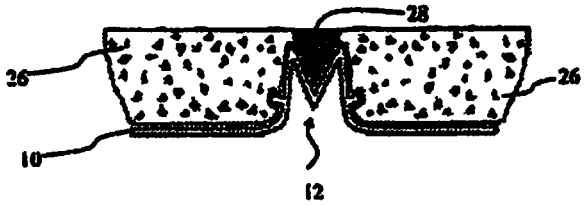
Figure 5:
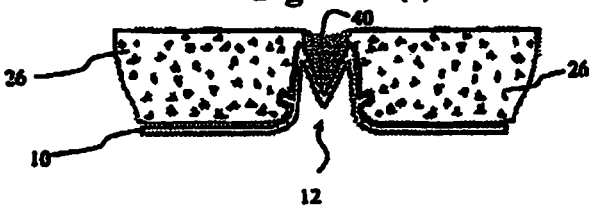

As depicted in FIG. 5(*a*), in the prior art, building material 26 is applied to expansion or control joint 10 up to the top edge 13 of expansion region 12. Tape 15 is placed over V-shaped center portion 30 of expansion region 12 to prevent building material 26 from entering V shaped center portion 30 during installation. After building material 26 has cured, there is no significant bond between building material 26 and expansion or control joint 10. Because there is no significant bond, water penetrates between the expansion or control joint 10 and the building material 26 at the interface and under building material 26, and/or at the top edge 13.

In one example, as depicted in FIGS. 5(*b*)-6, a removable gasket 18, such as a removable V-shaped gasket 28, is used to form an opening, providing a "caulk tray" for a bead of sealant. The removable V-shaped gasket 28 may be disposed in overlying relation within a V-shaped center portion 30 of an M-shaped expansion region 12. The V-shaped removable gasket 28 extends beyond top edge 13 of the M-shaped expansion region 12 such that a sufficient opening for the placement of sealant 40 is created when the removable V-shaped gasket 28 is removed. A sealant 40 is disposed within the opening, such that the sealant sufficiently bonds to the expansion or control joint 10 and to the building material 26, sealing the gap between them, after the gasket has been removed.

Figure 6:
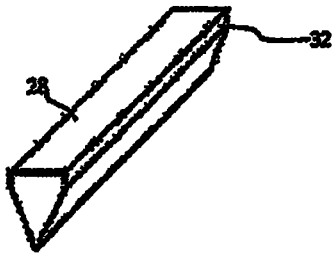
FIG. 6 depicts an upper perspective view of the M shaped expansion or control joint gasket used in FIG. 5(*b*).

As depicted in FIG. 6, a removable V-shaped gasket 28 comprises an upper extension 32. The upper extension 32 extends beyond top edge 13 of the M-shaped expansion region 12 of FIG. 5(*b*). The upper extension 32 may be used as a gage for application of a thickness of building material 26 as it is troweled, or otherwise applied, onto the substrate. Upper extension 32 allows for a thicker application of building material 26, thereby creating more surface area on building material 26 to which sealant 40 can be bonded, as depicted in FIG. 5(*c*).

Figure 7:
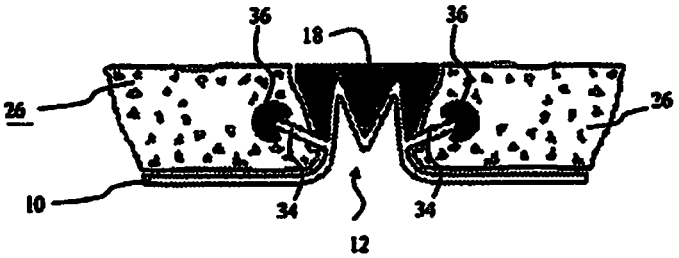
FIG. 7(*a*) depicts a bottom view of an M shaped expansion or control joint having a gasket that extends beyond the top edge of the expansion or control joint and a pair of permanent gaskets.
Figure 7:
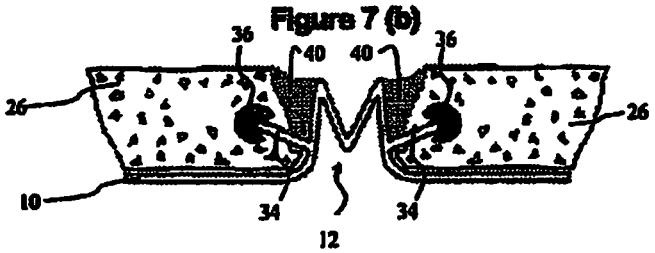

For example, as depicted in FIGS. 7(*a*) and 7(*b*), expansion or control joint 10 further includes at least one flange 34 protruding from the base of an M-shaped expansion region 12. As an added barrier to prevent the passage of water, permanent gasket 36 is disposed around said protruding flange. The permanent gasket may include any shape or size, for example.

As depicted in FIG. 8(*a*), in the prior art, a substrate 101, such as an exterior surface of a building already prepped for application of a building material 26, has a building material 26 applied on a surface of the substrate and is applied to the expansion or control joint 10 up to the top edge 13 of the expansion region 12. Each of the examples provided in this detailed disclosure includes such a substrate, but the substrate is not shown in detail or is not shown, because a person having ordinary skill in the art knows the various methods for prepping the substrate and that the expansion or control joint is fixed to the substrate, before the building material 26 is applied to the substrate 101. For example, a tape 15 may be placed over a V-shaped center portion 30 of an expansion region 12 to prevent the building material 26 from entering the V-shaped center portion 30 during installation. After the building material 26 has cured, there is no significant bond between building material 26 and expansion or control joint 10. Because there is no significant bond, water penetrates between the expansion or control joint 10 and the building material 26, under building material 26, and/or at the top edge 13. The prior art fails to apply a sealant or has no way to apply a sealant effectively.

In another example, as depicted in FIGS. 8(*b*)-9, a removable gasket 18 includes removable cap-shaped gasket 38. Removable cap-shaped gasket 38 fits in overlying relation to the M-shaped expansion region 12 such that the V-shaped center portion 30 of the M-shaped expansion region 12 remains empty and void. The removable cap-shaped gasket 38 extends laterally beyond the boundary of the M-shaped expansion region 12 such that a sufficient opening is created between the expansion or control joint 10 and the building material 26 when the removable cap-shaped gasket 38 is removed from M shaped expansion region 12. For example, the cap-shaped removable gasket 38 may extend 0.25" beyond the boundary of M shaped expansion region 12, providing a 025" opening and a V-shaped "caulk tray" for the sealant. As depicted in FIG. 8(*c*), the sealant 40 is disposed within the opening and sufficiently bonds to the expansion or control joint 10 and to the building material 26, sealing the gap between them, after the gasket has been removed.

Figure 9:
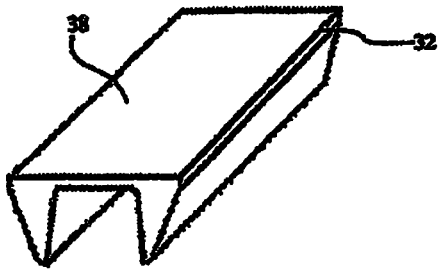
FIG. 9 depicts an upper perspective view of the M shaped expansion or control joint gasket used in FIG. 8(*b*).

For example, as depicted in FIG. 9, the removable cap-shaped gasket 38 includes an upper extension 32 that extends beyond the top edge 13 of the M-shaped expansion region 12 of FIG. 8(*b*). The upper extension 32 can be used as a gauge for the thickness of building material 26 as it is troweled on. The upper extension 32 allows for a thicker application of building material 26, thereby creating more surface area on building material 26 to which a sealant 40 can be bonded, as depicted in FIG. 8(*c*), when sealant is disposed in the opening.

Figure 10:
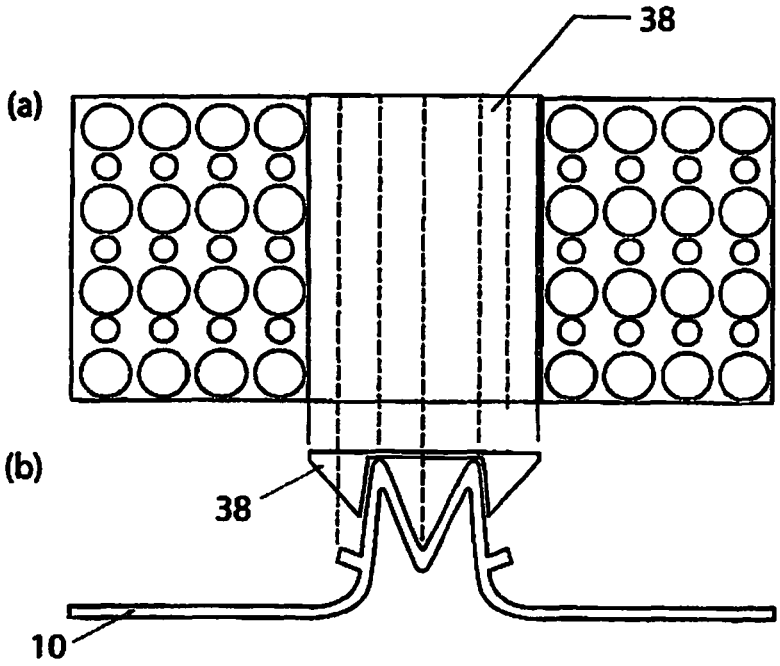
FIG. 10 depicts a structural relationship between a top view and a bottom view of the M-shaped expansion or control joint of FIG. 8(*b*) with a smaller gasket.

FIG. 10 depicts a structural relationship between a top view and a bottom view of the expansion or control joint 10 of FIG. 8(*b*), for example. The dotted lines depicted in FIG. 10 illustrate this structural relationship of where the aspects of the top view of this example may align with the aspects of the bottom view of this example. This example also depicts an isosceles triangle on each side of the gasket 38 with a 0.25" vertical measurement and a 0.25" horizontal measurement.

Figure 11A:
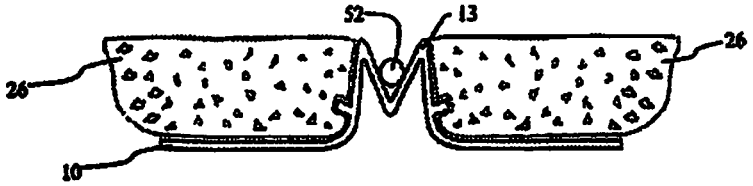
FIG. 11(*a*) depicts a bottom view of an M shaped expansion or control joint having a sufficient opening for the placement of a backer rod to reduce water penetration into the expansion or control joint.
Figure 11B:
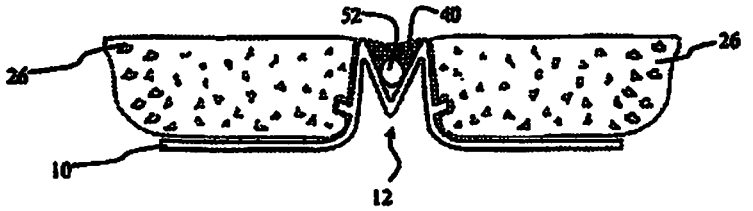

In another example, as depicted in FIG. 11(*a*)-(*b*), a backer rod 52 is installed upon removal of a removable gasket. The backer rod 52 may be installed with no sealant, as depicted in FIG. 11(*a*), or sealant 41 may be disposed in overlying relation to the backer rod 52, as depicted in FIG. 11(*b*). Any backer rod known in the art may be used. The backer rod 52 may be installed upon removal of the removable gasket, whether the removable gasket 18 of FIG. 3(*b*) or FIG. 7(*a*), the removable gasket 28 of FIG. 5(*b*), the removable gasket 38 of FIG. 8(*b*), or another suitably-shaped removable gasket is utilized within any suitably-shaped expansion region 12 of an expansion or control joint 10. The backer rod 52 may help the integrity of the expansion or control joint and/or the sealant, which may, in turn, reduce water penetration into the expansion or control joint 10, under the building material 26, and/or at the top edge 13.

Figure 12A:
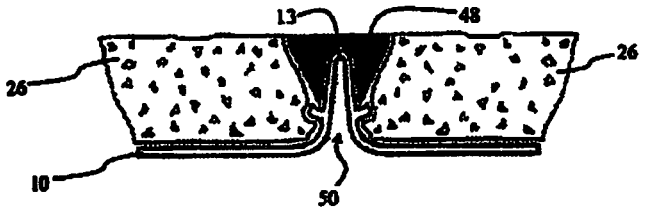
FIG. 12(*a*) depicts a bottom view of an A shaped expansion or control joint having a gasket that extends beyond the top edge of the expansion or control joint.
Figure 12B:
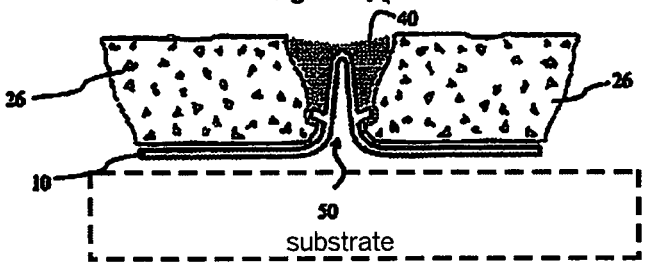

In another example, as depicted in FIGS. 12(*a*)-(*b*), a removable gasket 18 comprises an A-shaped gasket 48. The removable A-shaped gasket 48 fits in overlying relation to the A-shaped expansion region 50. The removable A-shaped gasket 48 extends laterally beyond the boundary of the A-shaped expansion region 50 such that a sufficient opening is created between the expansion or control joint 10 and the building material 26, when the removable A-shaped gasket 48 is removed from the A-shaped expansion region 50. As depicted in FIG. 12(*b*), a sealant 40 is disposed within the opening and sufficiently bonds to the expansion or control joint 10 and to the building material 26, sealing the gap between them, after the gasket has been removed, whereby an exterior vertical wall of the building is made water resistant.

Figure 13:
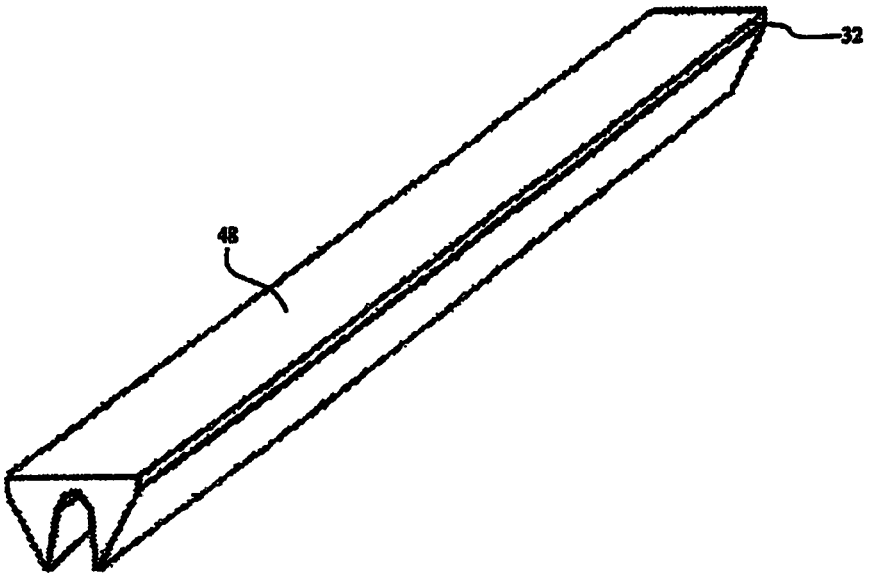
FIG. 13 depicts an upper perspective view of the A shaped expansion or control joint gasket used in FIG. 12(*a*).

Moreover, as depicted in FIG. 13, the removable A-shaped gasket 48 comprises an upper extension 32 that extends beyond the top edge 13 of the A-shaped expansion region 50 of FIG. 12(*a*). The upper extension 32 can be used as a gauge for the thickness of the building material 26 to be applied, such as by troweling it on. The upper extension 32 allows for a thicker application of building material 26, thereby creating more surface area on the building material 26 to which the sealant 40 is bonded, as depicted in FIG. 12(*b*), for example.

Figure 14:
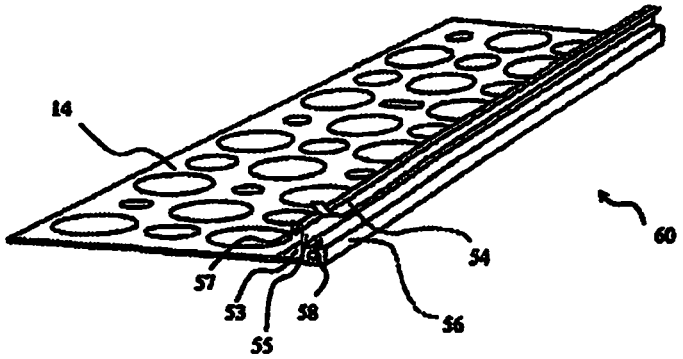
FIG. 14 depicts an upper perspective view of an expansion or control joint having a "casing bead" with termination channel and removable gasket strip with a pre-installed gasket or backer rod.
Figure 15A:
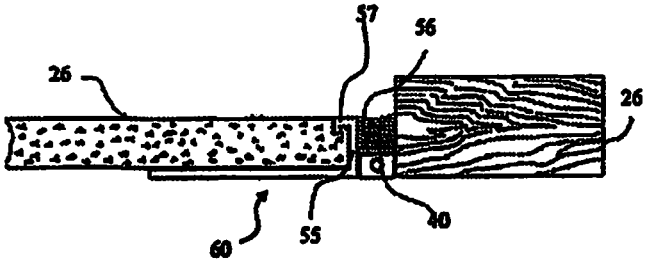
FIG. 15(*a*) depicts a bottom view of the expansion or control joint of FIG. 14 with termination channel and removable gasket strip with a pre-installed gasket or backer rod.
Figure 15B:
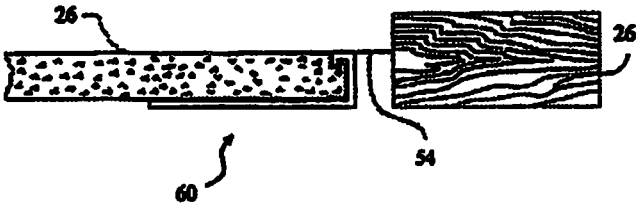

As depicted in FIGS. 14 and 15(*a*)-(*b*), another example comprises an expansion or control joint having a "casing bead" shape. It acts as a gauge for the placement of a casing bead, denoted generally by the reference numeral 60, on various systems, including stucco systems, for example. It leaves an opening 58 at its termination point to be used as a "caulk tray." The casing bead 60 includes a substantially horizontal elongated base 53, a substantially vertical elongated flange 55 extending perpendicularly from the substantially horizontal elongated base 53. A return flange 57 may extend perpendicularly from the top of the substantially vertical elongated flange 55 and away from the termination channel 58. The angles between the substantially horizontal elongated base and the substantially vertical elongated flange and between the substantially vertical elongated flange and the return flange can vary depending on the shape of the casing bead needed at the termination point.

This example may have a removable gasket strip 54 abutting the substantially vertical elongated flange 55 and disposed in overlying relation to the termination channel 58 and to an optional permanent gasket or backer rod 56 placed between the bead 60 and the building material 26. When the removable gasket strip 54 is removed, it exposes the cavity 58 into which the sealant 40 can be disposed, creating a bond between the casing bead 60 and the building material 26, thus preventing water penetration at this termination channel 58. The removable gasket strip 54 may serve as a gauge for proper spacing and prevention of debris, including cement, from falling into the cavity 58. Moreover, the embodiment contemplates an optionally-installed seal, not shown, to help prevent leaks in the event a sealant fails.

Additionally, this expansion or control joint with the "casing bead" shape acts as a shield on the outside edge for the purpose of preventing mud or debris from falling into the resultant cavity (i.e., termination channel 58) while finishing. The embodiment may have a pre-installed gasket or backer rod 56. The purpose is to seal off the exterior stucco termination channel 58 (via the casing bead 60) from dissimilar/unwanted building material to which it is adjacent after installation. The termination channel 58 can thus also help enable thermal expansion and/or contraction of a wall or other plane.

Certain embodiments of the current invention contemplate removable gaskets of any shape or size necessary to be disposed within the expansion region of the expansion or control joint, such that, when removed, a sufficient opening for the placement of a sealant is created to sufficiently bond to the expansion or control joint and to the building material, sealing the gap between them.

The removable gasket and/or expansion or control joint may be any shape or size used at control joints and at termination points such as doors and windows. The general idea is to create a bond between the two dissimilar building products which in normal circumstances would not bond together. The means to achieve this is by installing a removable gasket to create a caulk tray and create a sufficient opening for the placement of a sealant after removal of the gasket. The sealant sufficiently bonds to the expansion or control joint and to the building material, sealing the interface between them, or bridges the building material across the expansion or control joint, bonding to the adjacent building materials, sealing the interface between them. This creates a more water resistant expansion or control joint.

Various combinations and arrangement of the disclosed features may be made, as will be recognized by a person having ordinary skill in the art, and the disclosure and drawings are illustrative and should not be interpreted as limiting the claims.

This detailed description provides examples including features and elements of the claims for the purpose of enabling a person having ordinary skill in the art to make and use the inventions recited in the claims. However, these examples are not intended to limit the scope of the claims, directly. Instead, the examples provide features and elements of the claims that, having been disclosed in these descriptions, claims and drawings, may be altered and combined in ways that are known in the art.

What is claimed is:

1. An exterior wall system for a building comprises:

an exterior wall substrate, the exterior wall substrate being disposed vertically to the ground and providing an exterior surface for the building;

a control joint disposed on the substrate, the control joint comprising:

a base plate for attaching the control joint to the substrate, the base plate having an elongated length defined by a first end and a second end, opposite of the first end and a width defined by a first edge and a second edge, opposite of the first edge; and an A-shaped ridge extending from the base plate along the elongated length between the first edge and the second edge, and having a wider portion of the A-shaped ridge extending from the base to a peak portion of the A-shaped ridge, and wherein the peak portion of the A-shaped ridge is arcuate;

a building material applied on the substrate, whereby water resistance is provided to the exterior wall system for the building, wherein the base plate of the control joint is covered by the building material, and wherein the peak portion of the A-shaped ridge is not covered by the building material;

wherein a gap is defined between a first area covered in the building material on a first side of the A-shaped ridge and a second area covered in the building material on a second side of the A-shaped ridge opposite of the first side of the A-shaped ridge;

a pair of caulk trays are defined, extending along the elongated length, a first one of the pair of caulk trays being defined between the first side of the A-shaped ridge and the first area covered in the building material, and a second one of the pair of caulk trays being defined between the second side of the A-shaped ridge and the second area covered in the building material;

a sealant disposed in both of the first one of the pair of caulk trays and the second one of the pair of caulk trays; and the sealant extends over the A-shaped ridge of the control joint.

2. The exterior wall system of claim 1, wherein the sealant adheres to a portion of the building material of the first area on the first side of the A-shaped ridge and to a portion of the building material of the second area on second side of the A-shaped ridge, wherein the sealant seals the gap.

3. The exterior wall system of claim 1, wherein a removable member is disposed within the pair of caulk trays, whereby the gap is defined by the shape of the removable member.

4. The exterior wall system of claim 3, wherein the removable member is a gasket.

5. The exterior wall system of claim 1, wherein the sealant adheres to a portion of the building material of the first area on the first side of the A-shaped ridge and to a portion of the building material of the second area on the second side of the A-shaped ridge.

6. The exterior wall system of claim 5, wherein the sealant seals the gap.

7. A method of applying the exterior wall system of claim 1, comprising:

attaching the base plate of the control joint to the substrate of the exterior wall system;

applying the building material to the first area, covering the first area and the first edge of the base plate of the control joint;

applying the building material to the second area, covering the second area and the second edge of the base plate of the control joint;

providing a gap between the first area and the second area such that the A-shaped ridge extends into the gap between the first area and the second area; and sealing the gap with a sealant that covers the peak of the A-shaped ridge.

8. The method of claim 7, wherein the step of providing a gap further comprises:

disposing a removable member in the gap prior to each of the steps of applying; and removing the removable member during the step of providing, while the control joint remains attached to the substrate.

9. The method of claim 8, wherein the step of sealing the gap disposes a sealant of a silicone in the pair of caulk trays.

10. The method of claim 8, wherein the step of sealing covers the A-shaped ridge with the sealant and adheres the sealant to a portion of the building material of the first area on the first side of the A-shaped ridge and to a portion of the building material of the second area on the second side of the A-shaped ridge.

11. The method of claim 10, wherein the sealant seals the gap.

* * * * *